US007418846B2

(12) United States Patent
James et al.

(10) Patent No.: US 7,418,846 B2
(45) Date of Patent: Sep. 2, 2008

(54) LOCK BOX USING PUCK LOCK

(75) Inventors: Derrick L. James, Beloit, WI (US); John W. Kroening, Rockford, IL (US)

(73) Assignee: Greenlee Textron Inc., Rockford, IL (US)

( * ) Notice: Subject to any disclaimer, the term of this patent is extended or adjusted under 35 U.S.C. 154(b) by 0 days.

(21) Appl. No.: 11/479,906

(22) Filed: Jun. 30, 2006

(65) Prior Publication Data

US 2007/0240461 A1 Oct. 18, 2007

Related U.S. Application Data

(63) Continuation-in-part of application No. 11/404,349, filed on Apr. 14, 2006.

(51) Int. Cl.
*B65D 55/14* (2006.01)

(52) U.S. Cl. ..... 70/159; 70/32; 70/54; 70/164; 292/148

(58) Field of Classification Search ..... 70/56, 70/63, 159–162, 164, 2, 7, 13, 32, 54–55, 70/417, 34; 292/8, 32, 40, 104, 137–138, 292/148, 150, 156–157, 174, 205, 302, DIG. 11
See application file for complete search history.

(56) References Cited

U.S. PATENT DOCUMENTS 3,334,933 A 8/1967 Ehlers
4,655,487 A 4/1987 Korn et al.
4,754,626 A 7/1988 Siegel
5,076,078 A 12/1991 Weger, Jr.
5,308,126 A 5/1994 Weger et al.
5,469,722 A * 11/1995 Ellefsen ..... 70/56
5,918,491 A * 7/1999 Maxwell et al. ..... 70/164
6,494,064 B1 12/2002 Pena
6,772,613 B2 8/2004 Webb et al.
6,823,701 B1 * 11/2004 Gogel ..... 70/56
7,021,678 B1 4/2006 Raoult
2002/0108410 A1 8/2002 Webb et al.
2002/0178767 A1 * 12/2002 Lemley et al. ..... 70/56
2004/0123636 A1 7/2004 Linares
2005/0247084 A1 11/2005 Rosenberg

* cited by examiner

*Primary Examiner*—Patricia Engle
*Assistant Examiner*—Christopher Boswell
(74) *Attorney, Agent, or Firm*—Kurt J. Fugman

(57) ABSTRACT

A lock box with a locking mechanism using a puck lock is provided that also has a handle for moving a locking bar from a locking to an unlocking position. Furthermore, the puck lock is permanently attached to the exterior of the lock box eliminating the possibility of losing the puck lock. The construction of the puck lock makes tampering with the locking system of the lock box impractical.

16 Claims, 7 Drawing Sheets

LOCK BOX USING PUCK LOCK

CROSS REFERENCE TO RELATED APPLICATIONS

This application is a continuation-in-part of Ser. No. 11/404,349, filed on Apr. 14, 2006, which claims benefit of provisional application Ser. No. 60/672,770, filed on Apr. 19, 2005.

BACKGROUND OF THE INVENTION

Lock or gang boxes are commonly used by contractors in the construction industry to provide a secure place for them to store their tools safely overnight or during other periods when they are not present to prevent others from taking their tools. These lock boxes typically use padlocks that are part of a locking mechanism which keeps the lid of the box closed and prevents its opening after the tools have been placed within the box and the padlock has been locked. Frequently, the padlock is situated within a pocket such that its body only partially protrudes therefrom even when the padlock is in an open configuration and the shank is substantially inaccessible at all times, preventing someone from cutting it with bolt cutters.

The disadvantage that these prior art lock boxes have is that they all have some of the internal moving parts of the locking mechanism attached to the front panel of the lock box. The resulting structure, which is necessary to accommodate the moving parts of the locking mechanism, creates obstructions that reduce the user's accessibility to the inside of the box for storage and also creates catch points upon which items may get stuck when trying to remove items from the box. Accordingly, there exists a need for a lock box that has a locking mechanism that maximizes the accessibility to the interior of the box and minimizes the difficulty of taking items out of the box.

Furthermore, many padlocks have a key tumbler that is made of brass. Even if the shackle can't be cut using bolt cutters, someone can break into the lock box by drilling out the tumbler portion of the padlock, rendering it incapable of locking the box. Accordingly, there also still exists a need for a lock box that uses a lock that cannot be easily tampered with, preventing someone from breaking into the lock box.

SUMMARY OF THE INVENTION

The present invention includes a container with an interior and exterior comprising a lid, a side panel, a locking bar that is substantially disposed within the interior of the container, a puck lock that is attached to the container, and an actuator for moving the locking bar. The actuator can move the locking bar from a position where it can be engaged by the puck lock, securing the lid of the container, to a position where the locking bar cannot be engaged by the puck lock. Then the lid can be opened. The actuator is accessible to a user without taking the puck lock off the container, which eases the use of the locking system.

A lock box comprising a lid, a bottom panel, a front panel, a right side panel, a left side panel, a back panel, which all define an exterior and an interior of the box. It further includes a locking mechanism that includes a puck lock that is attached to the exterior of the lock box and a locking bar that is substantially disposed within the lock box and that is movably attached to the lid. The locking bar has an actuator for moving the locking bar from a locked position where the locking bar can be engaged by the puck lock, securing the lock box, to an open position where the lid can be opened.

This construction allows a user to use the lock box in the following manner. The user unlocks the puck lock so that it disengages the locking bar, then he uses the actuator to move the locking bar so that the locking mechanism is in an unlocked configuration. The user does this without having to remove the puck lock from the lock box. Then the user pulls up on the lid so that the interior of the box can be accessed. After placing an item into or taking an item out of the box, the user pushes down on the lid until it is closed, then the user moves the locking bar via the actuator until the locking mechanism is in a locked configuration. Finally, the user locks the puck lock without having to attach the puck lock to the box.

DETAILED DESCRIPTION OF THE PREFERRED EMBODIMENT

Figure 1:
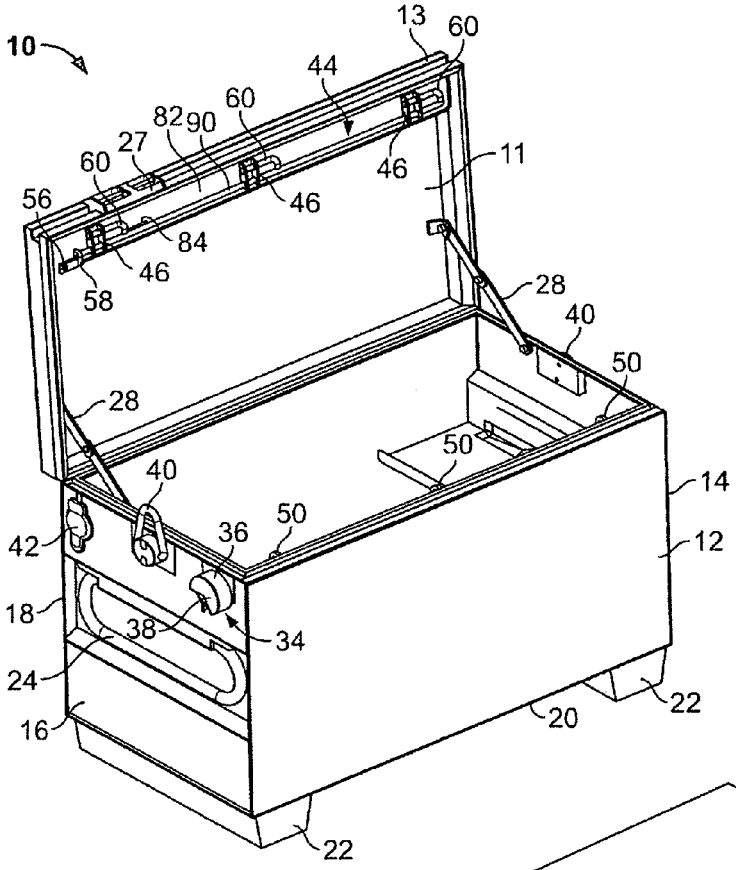
FIG. 1 is a perspective view of a lock box of the preferred embodiment of the present invention having a lid of the lock box in an open configuration.
Figure 2:
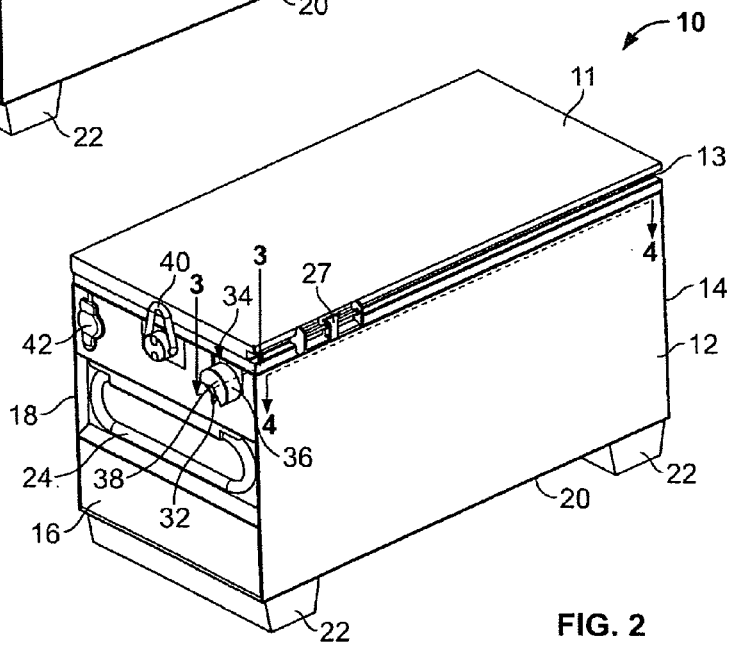
FIG. 2 is a perspective view of a lock box of the preferred embodiment of the present invention having a lid of the lock box in a closed and locked configuration.
Figure 3:
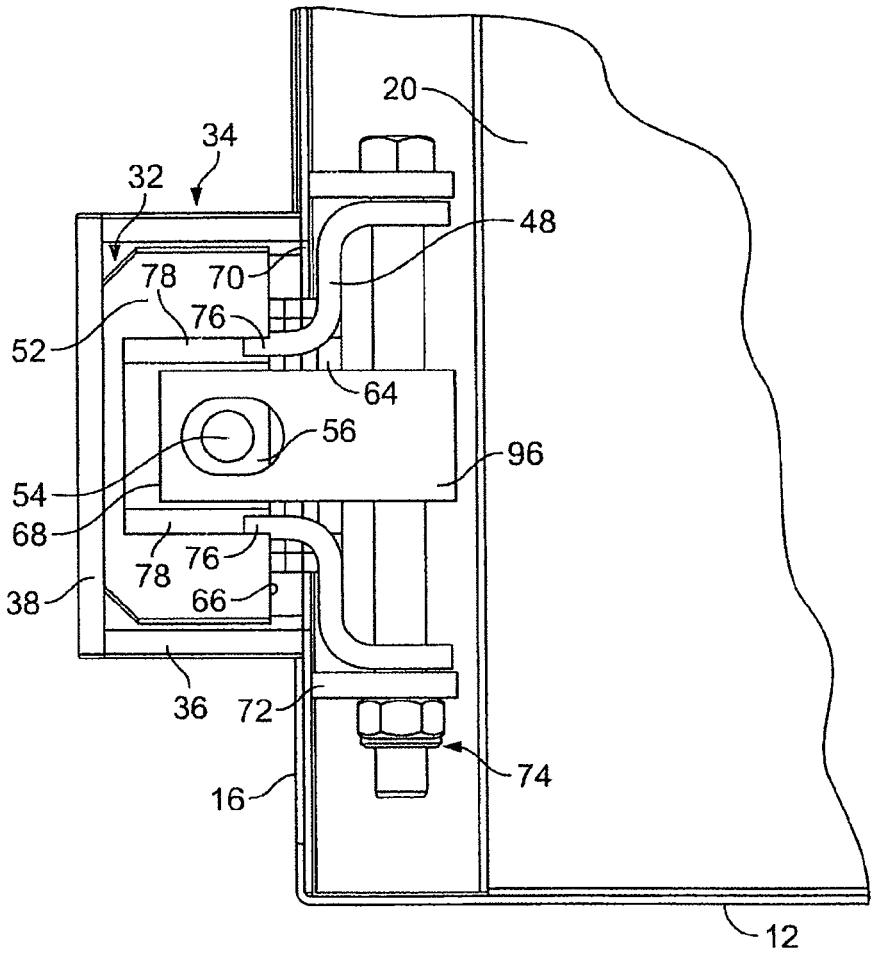
FIG. 3 is a top plan view of the locking mechanism of the lock box of FIG. 2 taken along section line 3-3.

Looking at FIGS. 1 and 2, there is shown the preferred embodiment of a lock box 10 that satisfies the aforementioned need. It comprises, in part, a lid 11, a front panel 12, a right side panel 14, a left side panel 16, a back panel 18, a bottom panel 20, skids 22, side handles 24, a locking mechanism 26, locking support arms 28, and finger slot 13. FIG. 1 shows the lock box 10 in an open configuration where the locking support arms 28 are temporarily fixed using known means, allowing the user to place tools into the box 10 without fear of the lid 11 falling onto some part of the user, causing injury. It should be noted that the moving components of the locking mechanism 26 are attached only to the lid 11, minimizing any obstructions that could get in the way of the user placing items into or removing items from the space found between the front panel 12, right side panel 14, left side panel 16, back panel 18, and bottom panel 20 of the lock box 10.

Once the user has placed all the items, such as tools, he wishes into the lock box 10, he can then disengage the locking support arms 28, allowing him to then pull onto the lid 11, which is hingedly connected to the top of the back panel 18, until it bottoms out onto the top of the front panel 12, right side panel 14, left side panel 16, and back panel 18. Then the user moves the slide 27, which is located within the finger slot 13 found on the front of the lid 11 of the lock box 10, to its extreme left position, placing the locking mechanism 26 of the box 10 into a locking configuration. Finally, the user places a key into the keyhole 29 and pushes and then rotates the key tumbler 30 of the puck lock 32 until the puck lock 32 is activated, preventing the locking mechanism 26 from disengaging the front panel 12 of the lock box 10. The lock box 10 is now locked, preventing anyone from lifting the lid 11 and accessing the items contained therein.

When the lock box 10 is in this closed configuration as shown in FIG. 2, the puck lock 32 is substantially inaccessible because it is covered by a shroud 34 comprising an arcuate skirt 36 that is welded to the left side panel 16 of the box 10 and a cover 38 that is welded to top of the arcuate skirt 36. This shroud 34 covers the majority of the puck lock 32, making any tampering with it impractical. Furthermore, the user can then move the lock box 10 easily by lifting and pulling onto one of the side handles 24, one of which that is not shown is attached near the top of the exterior of the right panel 14 while the other is attached to the top of the exterior of the left panel 16, until the lock box 10 slides on one of the skids 22, which is attached to the underside of the bottom panel 20 and is opposite of that handle 24. Alternatively, the box 10 could be lifted off the ground using lift rings 40, which are located immediately above the side handles 24, and moved to another desired location.

Finally, the box 10 also includes an electrical access cover 42 that can be flipped out of the way so that an electrical cord can pass through it, providing power for any equipment that is located within the box 10. The puck lock may be the same as but is not limited to any conventional puck lock as described in U.S. Pat. No. 3,769,821 issued to Randel. The puck lock may also be any type of padlock that does not have an exposed U-shaped shackle. Preferably, the puck lock 32 including its key tumbler 30 is protected by hardened steel so that a thief cannot drill into the puck lock 32 and disable it. This greatly enhances the overall security of the box 10.

Figure 4:
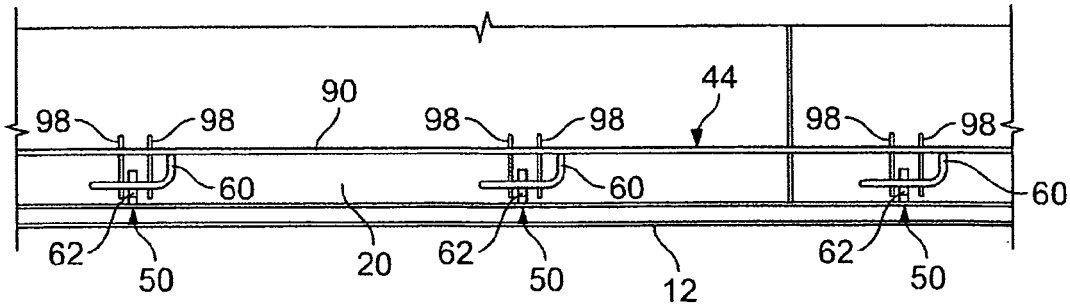
FIG. 4 is a top plan view of the locking mechanism of the lock box of FIG. 2 taken along line 4-4.
Figure 5:
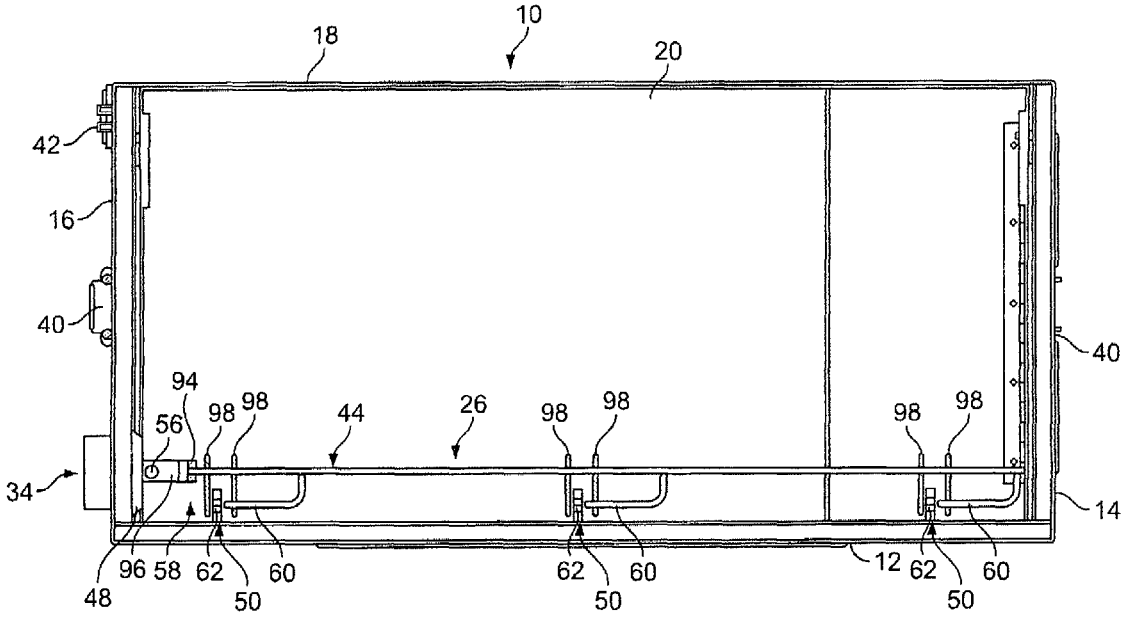
FIG. 5 is a top plan view of the locking mechanism of the lock box of FIG. 4 in an unlocked configuration.
Figure 6:
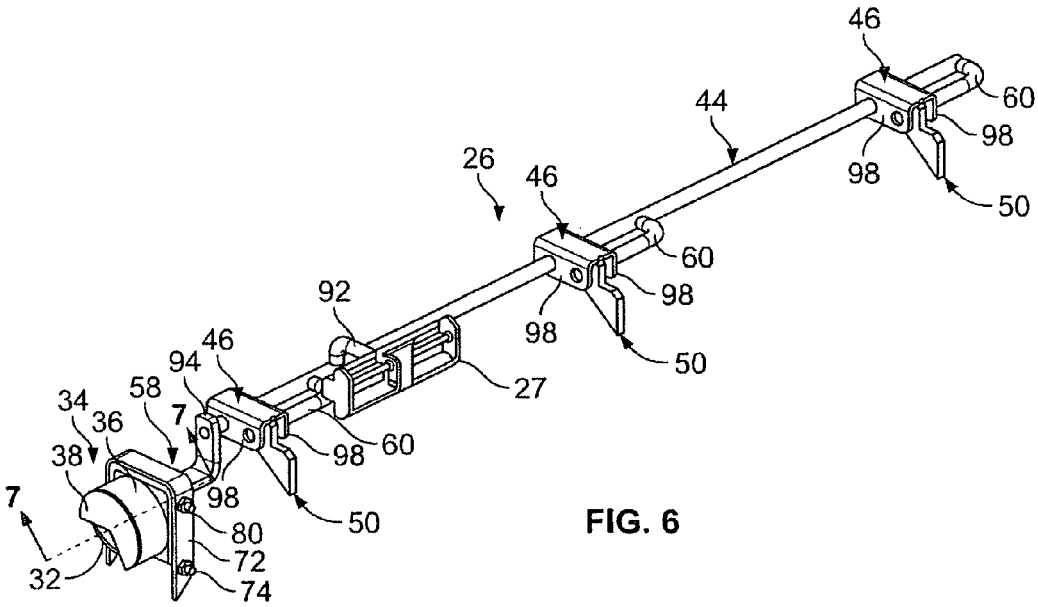
FIG. 6 is a perspective view of the locking mechanism of FIG. 5 removed from the lock box.
Figure 7:
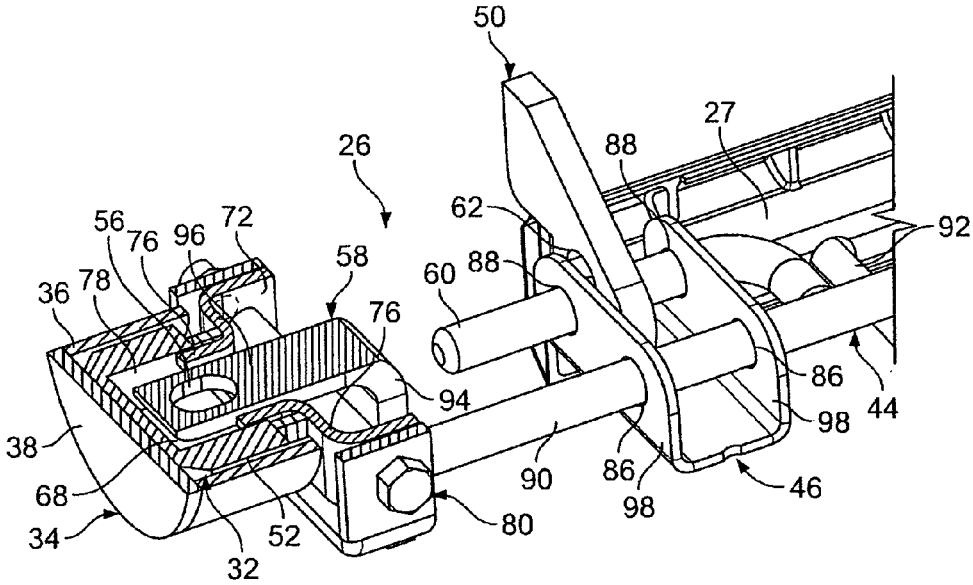
FIG. 7 is a perspective view of the locking mechanism of FIG. 6 taken along line 7-7.
Figure 10:
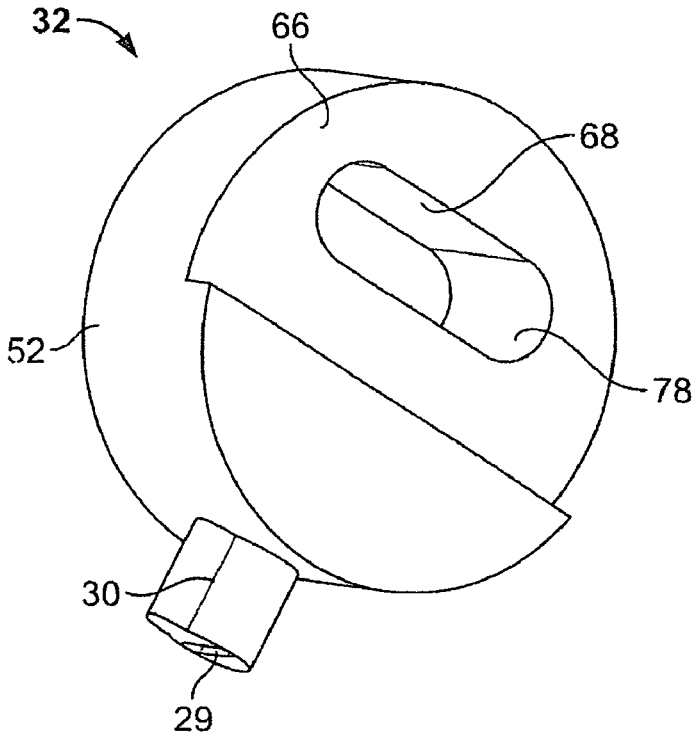
FIG. 10 is a perspective view of the puck lock in an unlocked configuration.
Figure 11:
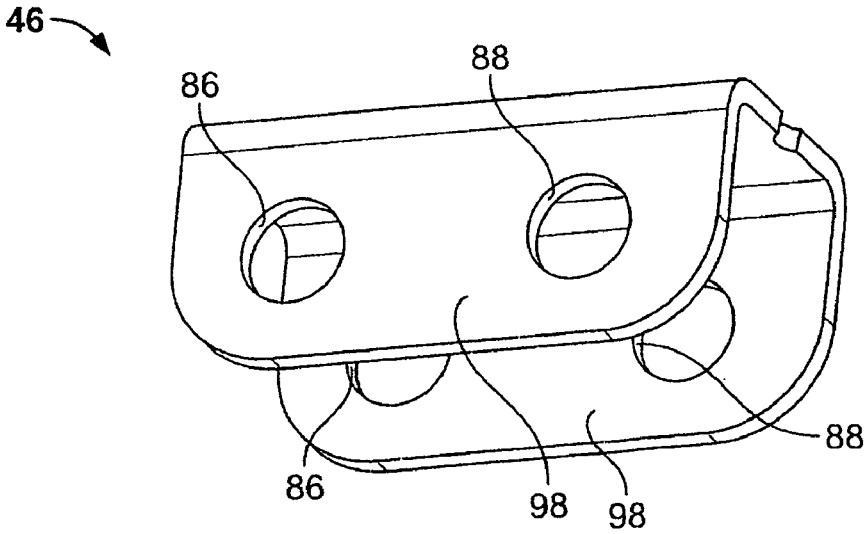
FIG. 11 is a perspective view of the guiding bracket.
Figure 12:
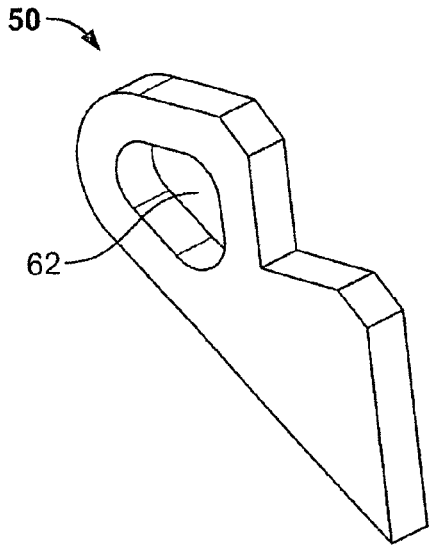
FIG. 12 is a perspective view of the flange.
Figure 13:
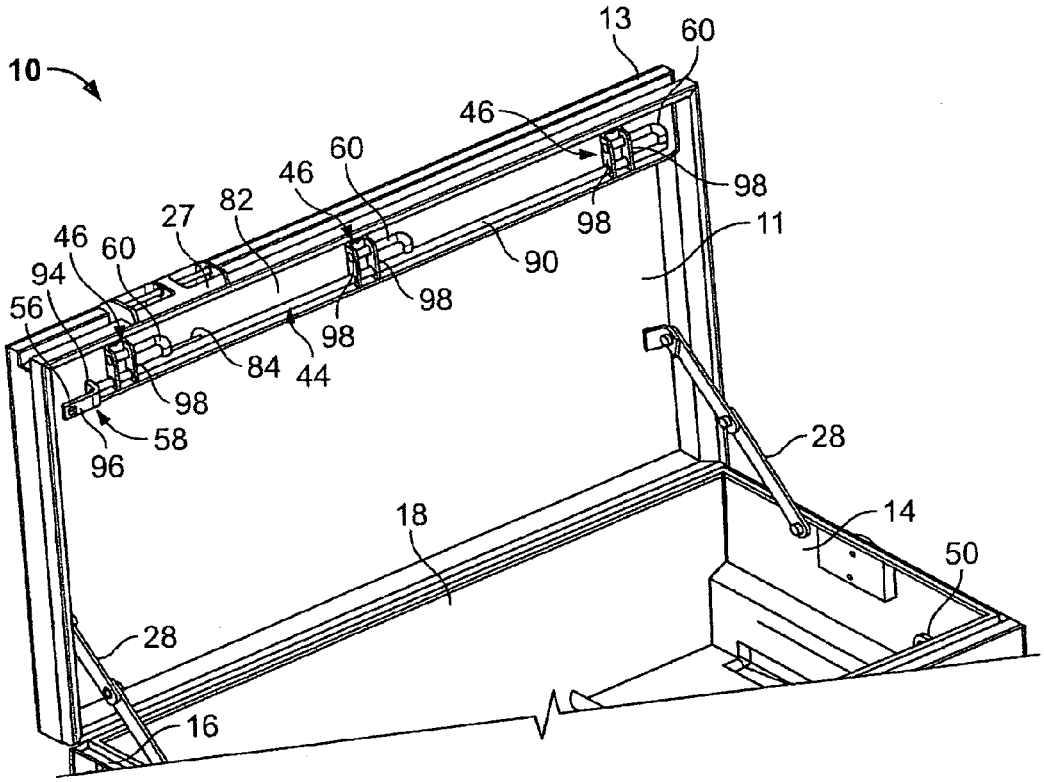
FIG. 13 is an enlarged view of the lid and back panel of the lock box of FIG. 1.

Referring now to FIGS. 3-7, the construction of the locking mechanism 26 and the way it works can be clearly seen. The locking mechanism 26 comprises, in part, a puck lock 32, a shroud 34, a locking bar 44, guide brackets 46, an access cover 48, a slide 27, and flanges 50. The open configuration of the locking mechanism 26 is created in the following manner. First, the user unlocks the puck lock 32 by inserting a key into the keyhole 29 located at the bottom of the body 52 of the puck lock 32. Then the user twists the key in the puck lock 32 and pulls on the key tumbler 30, which causes the shank 54 of the puck lock 32 to move away from the hole 56 found in the L-shaped member 58, which is fixedly attached to the locking bar 44. When the puck lock 32 is in an unlocked position as shown by FIG. 10, there is clearance between the shank 54 of the puck lock 32 and L-shaped member 58 of the locking bar 44 as best shown in FIG. 7. Then the user moves the slide 27 to its extreme right position until the hooks 60 that are attached to the locking bar 44 are no longer engaging the eye portions 62 of the flanges 50 that are attached to interior of the front panel 12 as shown in FIG. 5.

Once this open configuration of the locking mechanism 26 has been achieved, then the user places his hand within the finger slot 13 located at the front face of the lid 11 and pulls upward, opening the lid 11. It should be noted that the user does not need to remove the puck lock 32 from the box 10 to achieve a locking mechanism 26 that is in the open configuration. This prevents the user from pinching their fingers when taking the puck lock 32 off the box 10 and from potentially losing the puck lock 32. Now, the user can place items into or take items out of the box 10 with the lid 11 open.

Figure 9:
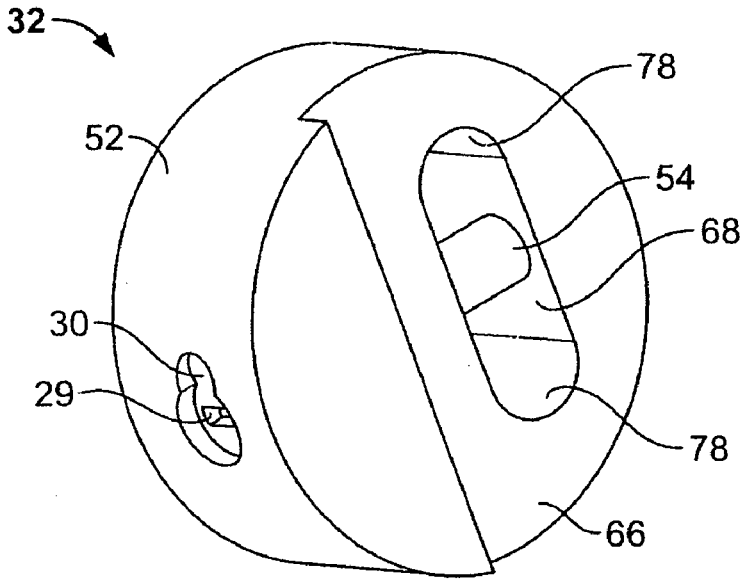
FIG. 9 is a perspective view of the puck lock in a locked configuration.

Conversely, the closed configuration is achieved in the following manner. First, the user disengages the locking support arms 28. Then he places his hand within the finger slot 13 located at the front face of the lid 11 and pulls downward until the lid 11 bottoms out on the front 12, back 18, right side 14, and left side 16 panels. Then the user moves the slide 27 to its extreme left position where the L-shaped member 58 of the locking bar 44 passes through a slot 64 found on the access cover 48 located between the interior of the box 10 and the rear face 66 of the puck lock 32 until the L-shaped member 58 is seated within a slot 68 found on the rear face 66 of the puck lock 32 and is aligned with the path of the shank 54 of the puck lock 32. At the same time, the hooks 60 of the locking bar 44 pass through the eye portions 62 of the flanges 50 as shown in FIG. 4. At this time, the lid 11 of the box 10 cannot be lifted up. Then the user inserts the key into the keyhole 29 of the puck lock 32 and pushes the key tumbler 30 until the shank 54 passes through the hole 56 of the L-shaped member 58 of the locking bar 44 and twists the key until the puck lock 32 is locked as shown in FIG. 9. This prevents any lateral movement of the locking bar 44 and ensures that the hooks 60 of the locking bar 44 will remain engaged with the flanges 50 that are attached to the front panel 12 of the lock box 10 at all times. Thus, the lock box 10 is secured and the items within the box 10 cannot be accessed. It should be noted that the puck lock 32 does not have to be reattached to the box 10 to achieve this closed configuration.

Figure 8:
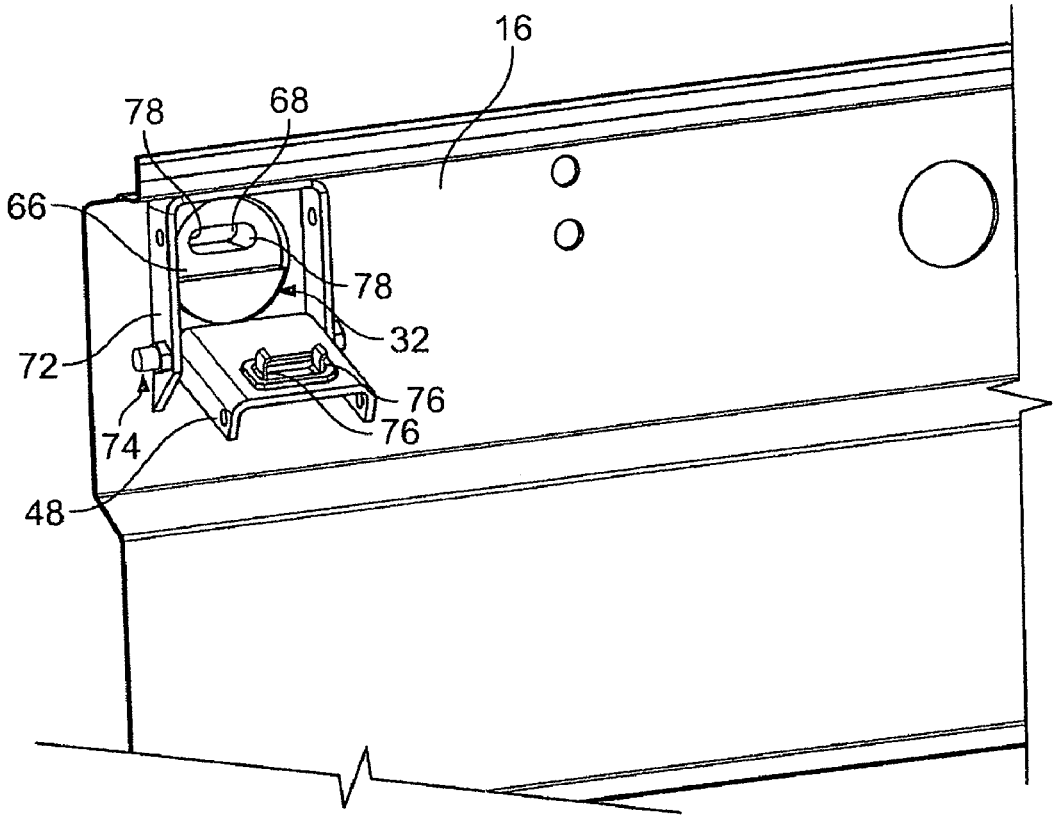
FIG. 8 is a perspective view showing how the puck lock is attached to the left side panel of the lock box of FIG. 1.

FIGS. 1, 5, 6, 7, 8 and 13 show how the locking mechanism 26 is assembled and attached to the lid 11 of the lock box 10. First, the shroud 34 is welded onto the exterior of the left side panel 16 near its top portion where it is concentric with a hole 70 that is configured to allow the puck lock 32 to pass through. This is necessary because the shroud 34 captures the puck lock 32 and prevents its removal from the exterior of the box 10. Next a frame 72 is centered with respect to the receiving hole 70 for the puck lock 32 and is welded onto the interior of the left side panel 16. A first hex bolt and nut assembly 74 is attached to the bottom of the frame 72. This assembly 74 provides a pivoting connection for the access cover 48 so that it can be rotated down and out of the way when the puck lock 32 is being replaced as shown in FIG. 8. Once the puck lock 32 is in place, the access cover 48 can be rotated upward until its two projections 76 are seated within the half round surfaces 78 of the slot 68 found on the rear face 66 of the puck lock 32, providing the correct orientation of the puck lock 32. Finally, a second hex bolt and nut assembly 80 is used to fix the position of the access cover 48 as shown in FIG. 6. At this time, the slot 64 found on the access cover 48 is in alignment with the slot 68 on the rear face 66 of the puck lock 32 such that the L-shaped member 58 of the locking bar 44 can pass through both of them. This completes the attachment of the puck lock 32 to the lock box 10.

The attachment of the locking bar 44 and slide 27 to the lid 11 of the lock box 10 is achieved in the following manner. First, a bolster plate 82 is provided with a slot 84 at one end. Three identical guide brackets 46 are welded to the underside of the lid 11. The first bracket 46 is located in the middle of the bolster plate 82 and the second and third brackets 46 are found equidistant from first bracket 46. The bracket is a U-shaped channel that has a first set of holes 86 that are in alignment with each other and a second set of holes 88 that are in alignment with each other. The first sets of holes 86 of each bracket 46 are also in alignment, as are the second sets 88 of holes. The main shaft 90 of the locking bar 44 is inserted through the first set of holes 86 of all three brackets 46. Next, each of the three hook portions 60 are welded onto the main shaft 90 adjacent to a bracket 46 such that each is capable of passing through the second set of holes 88 of that bracket 46. Then a connecting arm 92 is passed through the slot 84 of the bolster plate 82 and welded onto the main shaft 90 of the locking bar 44. Finally, the first leg 94 of the L-shaped member is welded to the end of the main shaft 90 of the locking bar 44 such that its second leg 96 with the hole 56 in it will remain parallel with the three hook portions 60 when the locking bar 44 is moved laterally. The subassembly of the locking bar 44 to the bolster plate 82 is now complete.

This subassembly is maneuvered such that the free end of the connecting arm 92 can extend through a slot (not shown) found within the finger slot 13 of the lid 11. The bolster plate 82 is then when welded into place on the lid 11. At this point, the slide 27 is attached to the connecting arm 92 by a pin connection (not shown). From this time forward, any movement of the slide 27 is transferred to the connecting arm 92, and to the locking bar 44. The slot on the lid is configured to match the slot 84 found on the bolster plate 82. Together they make sure that the proper sliding distance is allowed for effectuating the locking and unlocking configurations of the locking mechanism 26. Hence, the slide 27 serves as an actuator that causes the locking bar 44 to achieve both the locking and unlocking configurations. The last step in completing the assembly of the locking mechanism 26 is to weld the three identical flanges 50 to the top portion of the interior surface of the front panel 12 such that they will align with the guide brackets 46 when the lid 11 of the box 10 is closed. Preferably, the eye portions 62 of the flanges 50 will be located between the ears 98 of the bracket 46 and must be in alignment with the second set of holes 88 of the bracket 46 so that the hook portion 60 of the locking bar 44 can pass through all three apertures. This arrangement ensures that each bracket 46 and flange 50 combination will provide three points of locking contact between the lid 11 and front panel 12 of the box 10. This also means that there are nine points of contact in total. This arrangement is preferred as it ensures that the rigidity of the locking mechanism 26 is sufficient to prevent someone from prying open the lock box 10.

As can be seen, this embodiment provides a lock box 10 that does not have any movable components of the locking mechanism 26 attached to any panel other than the lid, resulting in easy access to its interior. Furthermore, it should be appreciated that the spirit and scope of this invention could be achieved with other types of mechanisms including those that operate in a similar manner but only vary the number and position of hooks, brackets, and flanges. Also, the actuator used in the preferred embodiment was a mechanical slide. However, other actuators that are mechanical, electrical, magnetic, or electromechanical are also contemplated. For example, the actuator could be a solenoid that can be activated remotely by the user to create movement of the locking bar or it could be a spring, which biases the locking bar to move. Therefore, the spirit and scope of this invention should be interpreted in view of the attached claims.

What is claimed is:

1. A container with an interior and exterior comprising:

a lid;

a side panel;

a locking bar that is substantially disposed within the interior of the container;

a puck lock that is attached to the container, said puck lock comprising a body and a shank wherein said body does not move when locking and unlocking the container; and an actuator for moving the locking bar from a position where it can be engaged by the puck lock, securing the lid of the container, to a position where the locking bar cannot be engaged by the puck lock and the lid can be opened, said actuator being accessible to a user without taking the puck lock off the container.

2. The lock box of claim 1 wherein the puck lock is permanently attached to the exterior of the container, preventing the loss of the puck lock.

3. A lock box comprising:

a lid, a bottom panel, a front panel, a right side panel, a left side panel, a back panel, which all define an exterior and an interior of the box; and a locking mechanism that includes a puck lock that is attached to the exterior of the lock box and a locking bar that is substantially disposed within the lock box and that is movably attached to the lid, said puck lock comprising a body that does not move when locking or unlocking the lock box; and an actuator for moving the locking bar from a locked position where the locking bar can be engaged by the puck lock, securing the lock box, to an open position where the lid can be opened.

4. The lock box of claim 3 wherein the actuator is accessible from the exterior of the lock box and the puck lock is captured with respect to the exterior of the lock box, preventing the loss of the puck lock, and which further comprises an access cover that is located between the interior of the box and the puck lock, said access cover being movable to allow access to the puck lock so that the puck lock can be replaced.

5. The lock box of claim 3 wherein the locking bar has a sliding attachment to the lid of the box and the actuator comprises a handle that extends from the locking bar to the exterior of the box, making the handle accessible to a user.

6. The lock box of claim 5 wherein the puck lock includes a rear face and the locking bar slides in a direction that is substantially perpendicular to the rear face of the puck lock.

7. The lock box of claim 6 which includes at least one bracket with an aperture that is mounted to the underside of the lid and the locking bar comprises at least one hook that can slide through the aperture of the bracket.

8. The lock box of claim 7 wherein the lock box further comprises a flange that is attached to the interior of the front panel, said flange having an eye portion that is located such that the eye portion of the flange can receive the hook of the locking bar causing the box to be locked.

9. The lock box of claim 8 wherein the at least one bracket is substantially midway between the left and right panels and which further comprises a second bracket and a third bracket which are spaced substantially equidistantly from the first bracket and are attached to the underside of the lid, said second and third brackets also having apertures.

10. The lock box of claim 9 wherein the locking bar further comprises a second and third hook that are spaced substantially equidistantly from the first hook, which is located near the middle of the locking bar, said second and third hooks being configured to slide in the apertures of the second and third brackets respectively.

11. The lock box of claim 10 wherein the first flange is located midway between the left and right panels of the lock box and which further includes a second flange and a third flange that are also spaced equidistantly from the first flange, both of which have eye portions that are located such that these eye portions can receive the second and third hooks of the locking bar, enhancing the security of the lock box.

12. The lock box of claim 11 wherein all the brackets that are attached to underside of the lid are of the same configuration, said configuration being a substantially U shaped channel that has two holes that are in alignment such that the hooks of the locking bar can slide therein.

13. The lock box of claim 6 wherein the locking bar further comprises a L-shaped member with a first leg and a second leg, the first leg being attached to one end of the locking bar and the second leg having a hole.

14. The lock box of claim 13 wherein the puck lock further comprises an internal shank and a slot on the rear face of the puck lock that exposes the shank to the exterior of the puck lock, said puck lock being attached to the exterior of the box and being located such that the hole of the second leg of the L-shaped member of the locking bar can receive the shank, locking the lock box.

15. The lock box of claim 14 wherein said attachment of the puck lock is a permanent attachment so that the puck lock cannot be lost.

16. The lock box of claim 15 wherein the permanent attachment of the puck lock includes a shroud that is permanently attached to the exterior of the lock box and that substantially prevents someone from tampering with the puck lock.

* * * * *